US005545881A

United States Patent [19]

Chai et al.

[11] Patent Number: 5,545,881

[45] Date of Patent: Aug. 13, 1996

[54] HEATING TIME CONTROL APPARATUS AND METHOD THEREOF FOR MICROWAVE OVEN

[75] Inventors: Eun S. Chai; Kwan H. Lee, both of Kyungsangnam-Do, Rep. of Korea

[73] Assignee: LG Electronics Inc., Rep. of Korea

[21] Appl. No.: 425,594

[22] Filed: Apr. 20, 1995

[30] Foreign Application Priority Data

Dec. 16, 1994 [KR] Rep. of Korea ..... 34622/1994

[51] Int. Cl.[6] ..... H05B 6/68

[52] U.S. Cl. ..... 219/719; 219/703; 219/707; 219/710; 99/325

[58] Field of Search ..... 219/719, 703, 219/705, 707, 710, 492; 99/325, DIG. 14

[56] References Cited

U.S. PATENT DOCUMENTS

| | | | |
|---|---|---|---|
| Re. 31,094 | 11/1982 | Kobayashi et al. | 219/10.55 B |
| 4,335,293 | 6/1982 | Kobayashi et al. | 219/10.55 B |
| 4,336,433 | 6/1982 | Yokozeki | 219/10.55 B |
| 4,481,394 | 11/1984 | Tanabe | 219/705 |
| 4,499,357 | 2/1985 | Kojima | 219/719 |
| 4,864,088 | 9/1989 | Hiejima et al. | 219/707 |
| 5,155,339 | 10/1992 | An | 219/492 |
| 5,319,171 | 6/1994 | Tazawa | 219/705 |
| 5,369,253 | 11/1994 | Kuwata et al. | 219/707 |
| 5,436,433 | 7/1995 | Kim et al. | 219/703 |

*Primary Examiner*—Philip H. Leung

*Attorney, Agent, or Firm*—Ostrolenk, Faber, Gerb & Soffen, LLP

[57] ABSTRACT

An improved heating time control apparatus and method thereof for a microwave oven capable of advantageously computing an optimum cooking time without controlling the amount of food to be cooked. The invention includes: a sensor for detecting a predetermined physical, i.e. parameter, variation of the food being heated and for converting the physical variation into a predetermined electrical signal; a converter for comparing the physical variation outputted from the sensor with an initial value and for converting the physical variation into the varying ratio which is referenced to the initial value; a heating time detecting circuit for setting a first heating time obtained while the varying ratio outputted from the converter becomes a minimum value and for setting a time obtained while the varying ratio varies from the minimum value to a predetermined value as a second heating time; an operator for computing a predetermined value varied as much as a predetermined value in determining the second heating time using the minimum value of the varying ratio outputted from a storing circuit, the first heating time and a first coefficient outputted from the storing circuit and for producing a third heating time using the first and second heating times outputted from the storing circuit and a second coefficient outputted from a coefficient storing circuit; and a counter for counting the first and second heating times outputted from the heating time detecting circuit and a third heating time outputted from the operator.

9 Claims, 4 Drawing Sheets

HEATING TIME CONTROL APPARATUS AND METHOD THEREOF FOR MICROWAVE OVEN

BACKGROUND OF THE INVENTION

1. Field of the Invention

The present invention relates to a heating time control apparatus and a method thereof for a microwave oven, and particularly to an improved heating time control apparatus and method thereof for a microwave oven capable of advantageously computing an optimum cooking time without controlling food amount to be cooked or a predetermined initial cooking time by detecting varying rate of smell of the food thereby computing a cooking time in accordance with the detected varying rate of smell.

2. Description of the Conventional Art

Conventionally, in heating food using a microwave oven, an optimum heating time of food is determined by various factors such as an initial temperature and amount of food to be cooked, desired heating temperature and power of a microwave oven. One such method of determining an optimum heating time is disclosed in U.S. Pat. No. Re. 31,094, which detects an optimum food state using rapidly varying levels of moisture from food being cooked and a second heating time in accordance with the detected food state using a predetermined algorithm. However, in cases where moisture sharply increases as when cooking frozen food or where the moisture varying rate is low due to a food's particular characteristic during heating, there may be a big difference between a computed heating time and an actual heating time. In addition, in the case of warming food, the time during which the moisture amount increases sharply exceeds the time at which the level reaches 100° C. which is larger than the warming temperature of 60°–85°. Therefore, there is a big difference in heating time because the entire heating time is computed based upon a time when rapid changes of moisture occurs.

Accordingly, in an attempt to resolve such problems, U.S. Pat. No. 4,336,433 discloses a method, which is directed to differing a predetermined constant K of determining a food heating time in accordance with the kind and amount of food to be cooked in determining a second heating time. However, even though the constant K is computed in accordance with the kind and amount of food, since the initial state of food is not considered, there are still discrepancies between the computed heating time and the actually required heating time when frozen food is cooked and a food warming function is used. In addition, in determining the constant K, it takes much time because it comes from an experimental basis.

Furthermore, in an attempt to solve the above problems, U.S. Pat. No. 4,335,293 discloses an approach intended to set a time of increasing a predetermined time at a minimum of moisture variance as a first heating time and to set a second time in accordance with the set first heating time. However, the above retention has largely retained the same problems as in the prior art.

SUMMARY OF THE INVENTION

Accordingly, it is an object of the present invention to provide a heating time control apparatus and a method thereof for a microwave oven, which overcomes the problems encountered in the conventional heating time control apparatus and a method thereof for a microwave oven.

It is another object of the present invention to provide an improved heating time control apparatus and a method thereof for a microwave oven capable of advantageously computing an optimum cooking time without controlling food amount or a predetermined initial cooking time by detecting varying rate of smell of the food thereby computing a cooking time in accordance with the detected varying rate of smell.

To achieve one object thereof, there is provided with a heating time control apparatus for a microwave oven, which includes a sensor for detecting a predetermined physical variation in the food as the food is heated and for converting the physical variation into a predetermined electrical signal; a converter for comparing the physical variation outputted from the sensor with an initial value and for convening the physical variation into a varying ratio relative to an initial value; a heating time detecting circuit for setting a time, obtained while the varying ratio outputted from the converter becomes a minimum value, as a first heating time and for setting a time, obtained while the varying ratio varies from the minimum value to a predetermined value, as a second heating time; a storing circuit for a minimum value outputted from the heating time detecting circuit, the first heating time and the second heating time; a coefficient storing circuit for storing a predetermined coefficient in accordance with the kind of food to be cooked; an operator for computing a predetermined value varied as much as a predetermined value in determining the second heating time using the minimum value of the varying ratio outputted from the storing circuit, the first heating time and a first coefficient outputted from the storing circuit and for operating a third heating time using a first and second heating time outputted from the storing circuit and a second coefficient outputted from the coefficient storing circuit; a counter for counting a first and second heating time outputted from the heating time detecting circuit and a third heating time outputted from the operator; and an output drive circuit for controlling the microwave output level in accordance with an output signal of the counter.

To achieve another object thereof, there is provided with a heating time control method for a microwave oven, which includes a first step which converts a physical variation from food while the food is heated into a varying ratio relative an initial value and sets a time while the converted varying ratio becomes a minimum value as a first heating time; and a second step which computes a predetermined divided value by dividing the first heating time by a first coefficient in accordance with the kind of food being cooked and sets another time while the varying ratio converts as much as the divided value from the minimum value as a second heating time.

DETAILED DESCRIPTION OF THE INVENTION

Figure 1:
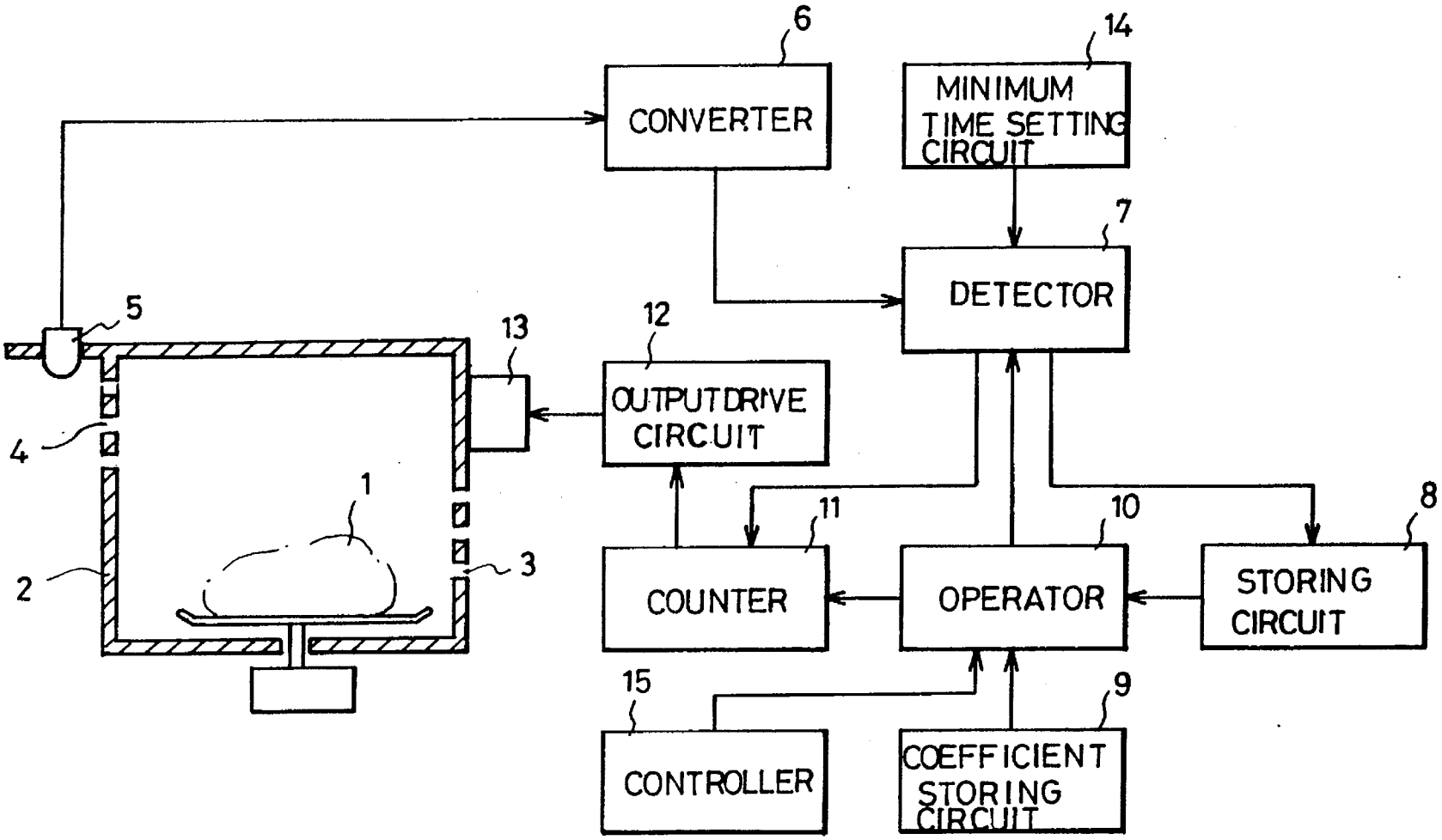
FIG. 1 is a block diagram showing a construction of a microwave oven according to the present invention.

Referring to FIG. 1, a heating time control apparatus of a microwave oven according to the present invention is provided with a heating compartment 2 for heating food 1. An air intake opening 3 is formed on a predetermined portion of the heating compartment 2 for intaking outside air into the heating compartment 2. An air exhausting opening 4 is formed on a predetermined portion of the heating compartment 2 for forcibly exhausting air containing food smell occurred while cooking food therein. A sensor 5 is mounted on a predetermined portion close to the air exhausting opening 4 for detecting smell exhausting from the air exhausting opening 4 and for convening the detected smell into a predetermined electric signal. In addition, the present invention is provided with a converter 6 for computing a varying ratio Rs/Ro for an initial value using an initial value Ro outputted from the sensor 5 and a varying value Rs obtained over a detector 7 for detecting a value dG1 which becomes a minimum value of a varying rate of smell outputted from the converter 6 and determining a preheating time Tp which is the lapsed time of detecting the value dG1 and for selecting a first heating time T1 by comparing the preheating time Tp and a predetermined time Train set at the minimum value setting section T1 described below and for determining a second heating time T2 by computing time lapsed for increasing a predetermined value dG outputted from the operator described below, a storing circuit 8 for storing a minimum value of a smell varying ratio outputted from the detector 7 and for the first and second heating time T1 and T2, a coefficient storing circuit 9 for storing experimentally determined coefficients a and K in accordance with a kinds of food, an operator 10 for operating a value of a smell varying ratio so as to determine a second heating time T2 using a minimum value dG1 of a smell varying ratio outputted from the storing circuit 8, a first heating time T1 and a coefficient 'a' outputted from the coefficient storing circuit 9 and for operating a third heating time T3 using a first, second heating times T1 and T2 outputted from the storing circuit 8 and a coefficient K outputted from the coefficient storing circuit 9, a counter 11 for counting a first and second heating times T1 and T2 outputted from the heating time detector 7 and a third heating time T3 outputted from the operator 10, an output drive circuit 12 for controlling a magnetron 13 in accordance with a output signal of the counter 11, and a magnetron 13 for transferring a microwave to the heating compartment 2 in accordance with a control of the output drive circuit 12.

In addition, the heating time control apparatus is further provided with a minimum time setting circuit 14 for outputting a predetermined time Tmin for being a first heating time T1 when a minimum value dG 1 of a smell varying ratio Rs/Ro is not detected from the heating time detector 7, and a heating time controller 15 for properly controlling the computed third heating time T3 when a user selects a heating level of the food 1 such as well down and rare.

The operation of a heating time control apparatus of a microwave oven will now be explained.

Figure 2:
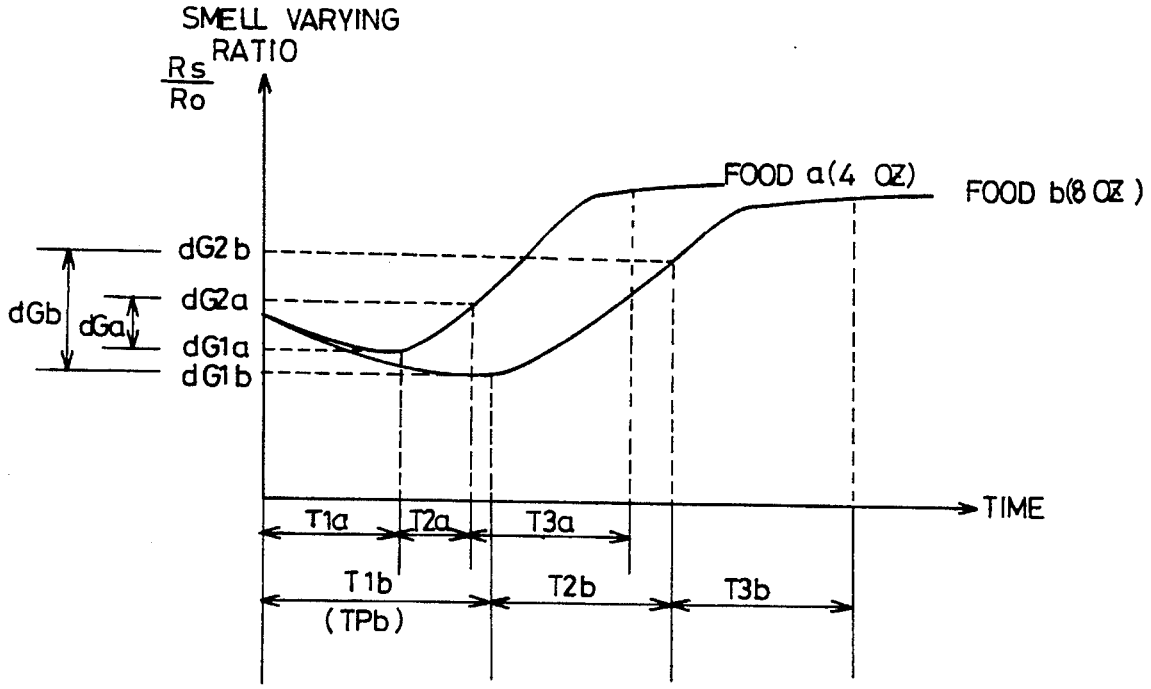
FIG. 2 is a graph showing a computation procedure of heating time according to the present invention.

When a cooking operation begins after a menu and heating level are selected by a user, the food in the heating compartment 2 is heated by microwaves outputted from the magnetron 13. At this time, gas and moisture coming from the food 1 is exhausted through the air exhausting opening 4. Thereafter, the sensor 5 detects the exhausting gas and moisture and converts the detected state into a predetermined electric signal and outputs the signal to the converter 6. As shown in FIG. 2, the converter 6 computes an initial value Ro outputted from the sensor 5 and a varying value Rs varying in accordance with a lapsing time, and computes a varying ratio smell ratio Rs/Ro. The heating time detector 7 detects a value dG1 which is a minimum value of the varying ratios of the smell and sets a preheating time Tp required for the detection.

Here, the varying ratio of the smell starts increasing as the heating operation proceeds while at the initial stage of the cooking operation it decreases due to the effects of the air sucked through the air intake opening 3. After the heating proceeds and the food is properly heated, the smell varying ratio Rs/Ro no longer increases due to the saturation of gas and smell in the heating compartment 2. In addition, in case of the same food, the preheating time Tp that the varying ratio of the smell is a minimum value dG1 become longer unless the amount of food is big, and the initial temperature is low, and the power of the microwave is low.

Thereafter, the heating time detector 7 outputs the minimum value dG1 to the storing circuit 8 and compares the preheating time Tp with the minimum time Tmin set in the minimum time setting circuit 14. As a result of the comparison, if Tp≧Tmin, the heating time detector 7 selects Tp as the first heating time T1 and outputs it to the storing circuit 8 and the counter 11, respectively. Meanwhile, if Tp≧Tmin, the heating time detector 7 selects Train as the first heating time T1 and outputs it to the storing circuit 8 and the counter 13. If Train is set as the first heating time T1, the value of the smell varying ratio at the point Train is selected and stored in the storing circuit 8. The counter 11 counts the first heating time T1 outputted from the heating time detector 7 and outputs the counted time to the output drive circuit 12. In addition, the output drive circuit 12 drives the magnetron 13 in accordance with a output signal of the counter 13, and the magnetron 13 supplies the heating compartment 2 with microwaves generated In accordance with a control of the output drive circuit 12.

The reasons why the preheating time Tp and the minimum time Train is selectively selected as the first heating time T1 is for the short duration even though the varying ratio of smell Increases or decreases while cooking food due to the characteristics of food or the heating condition. Because, in case that the varying ratio of smell is not decreased, since the preheating time is close to zero, the second and third heating times T2 and T3 which are determined by the first heating time T1 are not correctly computed. That is, in the case that the varying ratio of smell is not decreased or the duration is short even though it is decreased, the first heating operation is performed with a predetermined time Tmin set in the minimum time setting circuit 14, so that the second and third heating times T2 and T3 can correctly be computed.

Figure 3:
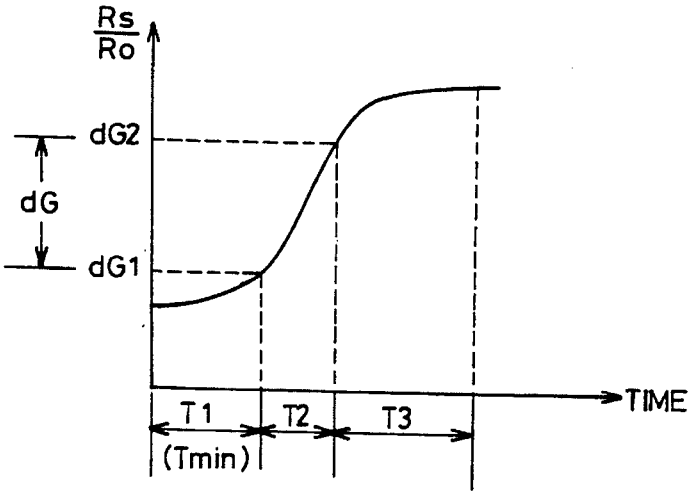
FIG. 3 is a graph showing a method of computing a first heating time when there is no a duration that a varying rate of food smell is reduced according to the present invention.

FIG. 2 shows a varying ratio of smell when foods 'a' and 'b' weighing 4 ounce and 8 ounce respectively, and that the relationship between the preheating time Tp and the minimum time Tmin is Tp≧Tmin. As shown therein the first heating time T1 is set as T1*a* and T1*b*, respectively. FIG. 3 shows the case where Tmin is selected as the first heating time T1, when Tp<Tmin, that is when the varying smell ratio from the food 1 is not decreased.

Meanwhile, the storing circuit 8 stores the output signals dG1 and T1 of the heating time detector 7. In addition, the operator 10 performs an operation of computing the second heating time T2 using a coefficient 'a' stored in the coefficient storing circuit 9, the coefficient "a" being selected on an experimental basis in accordance of the kind of food to be cooked. The operator 10 computes the value dG by dividing the first heating time T1 by the coefficient 'a,' and obtains the value dG2 by adding the value dG to the value dG1 outputted from the storing circuit 8. The condition is as follows.

dG=T1/a dG2=dG1+dG=dG1+T1/a

Wherein the second heating time T2 is determined as a lapsed time while the value dG1 becomes dG2 at a point after the first heating is completed. Therefore, if the value dG2 obtained from the operator 10 is outputted to the heating time detector 7, the heating time detector 7 detects lapsed time while the varying ratio dG1 of smell becomes the dG2 increased by dG and sets the detected lapsed time as the second heating time T2 and outputs it to the storing circuit 8 and the counter 11. Thereafter, the counter 11 counts the second heating time T2 and outputs the counted second heating time T2 to the output drive circuit 12. In addition, the output drive circuit 12 controls the oscillation of the magnetron 13 in accordance with an output signal of the counter 11.

FIG. 2 shows a lapsed time T2*a* and T2*b* each indicating a lapsed time while a varying ratio of smell from a food 'a' becomes a dG2*a* increased by dGa and a lapsed time while a varying ratio of smell from a food 'b' becomes a dG2*b* increased by dG. In addition, FIG. 3 shows the case where the second heating time T2 is determined in case that there is no decrease of a varying ratio.

The operator 10 computes the third heating time T3 using a first and second heating times T1 and T2 which are stored in the storing circuit 8 and a coefficient K stored in the coefficient storing circuit 9 determined in accordance with the kinds of food. The third heating time T3 is obtained by multiplying a result obtained by adding the first heating time T1 and the second heating time T2 by the coefficient K. That is, it is obtained by the condition below.

$$T3=(T1+T2)\times K$$

The operator 10 computed the third heating time T3 outputs the computed result to the counter 11. The counter 11 counts the second heating time T2 and the third heating time T3 outputted from the operator 10 and outputs it to the output drive circuit 12. The output drive circuit 12 controls the oscillation of the magnetron in accordance with a predetermined output signal of the counter 11. Thereafter, the magnetron 13 generates microwaves to the heating compartment 2 for the third heating time T3 in accordance with a drive of the output driving circuit 12 and then the heating operation is completed. The addition of the first, second and third heating times T1, T2 and T3 becomes the total heating time Tt. That is, the condition is given as follows.

$$Tt=T1+T2+T3=T1+T2+K\times(T1+T2)$$

Meanwhile, in case that a user wants to heat the food more or less, the user can control the cooking condition by controlling a heating time control section 15. When the user controls the heating time control section 15 in such a way, the heating time control section 15 outputs a predetermined coefficient β obtained in accordance with a heating level selected by the user to the operator 10 just after the third heating time T3 is computed. The operator 10 multiplies the computed total heating time Tt by the coefficient β and then adds or subtracts the multiplied result δT to or from the total heating time Tt. Therefore, the operator 10 outputs the third heating time T3' to the counter 11 in accordance with a predetermined heating level selected by a user. The relationship between the total heating time tt' and the third heating time T3' is given as follows.

$$\begin{aligned} Tt' &= Tt \pm \delta T \\ &= Tt \pm \beta \times (T1+T2+T3) \\ T3' &= T3 \pm \beta \times (Tt) \end{aligned}$$

Figure 4:
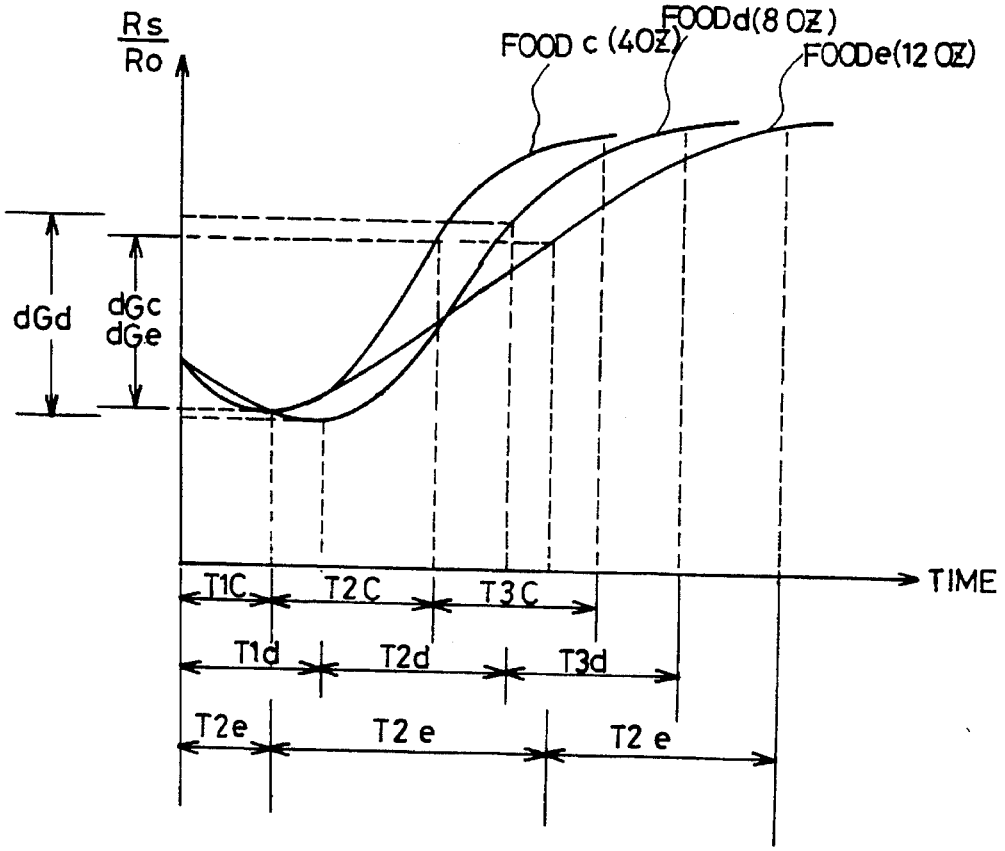
FIG. 4 is a graph showing a method of computing heating time in accordance with an amount and an initial state of food according to the present invention.

In addition, there are some occasions that a varying ratio of smell is low even though the weight of the food to be cooked is substantial. FIG. 4 shows that the foods c, d and e each weigh 4 ounces, 8 ounces and 12 ounces, and respectively that each Tp thereof is greater than Tmin. As shown in FIG. 4, even though the food e weigh more than the food d, the time T1*e* that the varying ratio of smell reaches a minimum is shorter than the T1*d* of the food d. In this case, since the second heating time T2 is determined by "dG2=dG1+dG=dG1+T1/a, the second heating time T2*d* for the food d is the time T2*d* while the varying ratio of smell increases by up to dGd= T1*d*/a. The second heating time T2*e* for the food e is the time T2*e* while the varying ratio of smell increase by up to dGe=T1*e*/a as well.

However, since the amount of the food e is greater than the food d, the slope of the varying ratio of smell of the food e is more slightly increased than that of the food d. Therefore, even though the variation amount dGe of the varying ratio of smell of the food e is less than that of the food d, the time T2*e* while the varying ratio of smell of the food e increase by up to dGe is longer than that of T2*d*. That is, whereas the first heating time T1 is determined by the initial characteristics of the food, after the second heating time T2, it is determined by characteristics of the graph showing a varying ratio of smell of food obtained in accordance with the amount of food. Therefore, the total heating time Tt is determined by the amount of the food to be cooked irrespective to the first heating time T1. Referring to FIG. 4, the first heating time T1*c* of the food c has the same time as in the first heating time T1*e*. However, since the amount of the food c is less than that of the food e, the total heating time Ttc is shorter than that of the food e.

Figure 5:
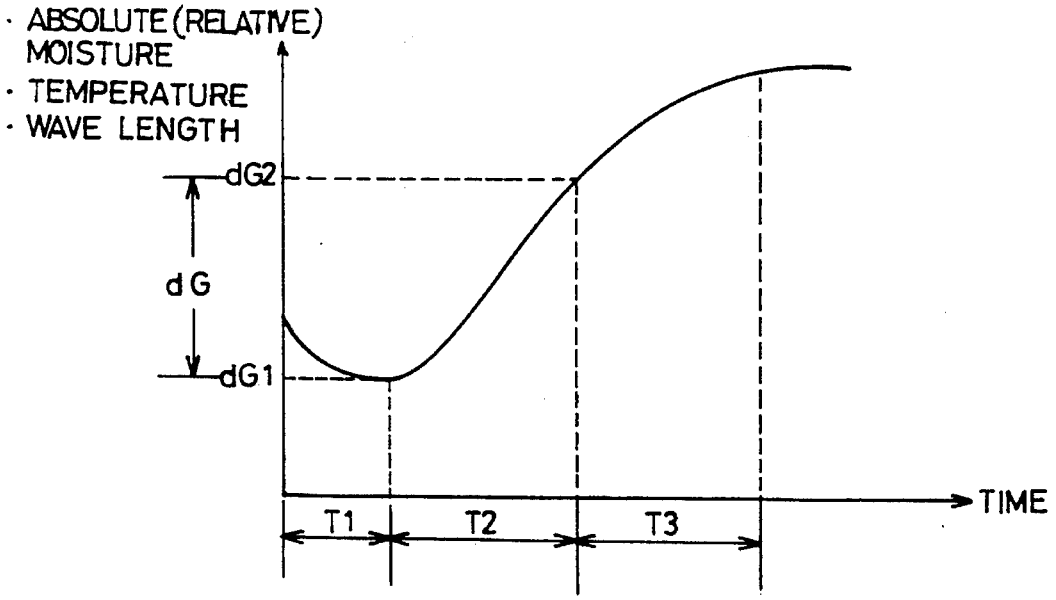
FIG. 5 is a graph showing a characteristic when various physical variations obtained while food is cooked are converted into a varying ratio for an initial state value of cooking.

Meanwhile, there are various methods so as to detect the heating level of food. Among the methods, detecting gas, temperature in the heating compartment, or infrared rays from the surface of the food is common. If the parameter to be detected is temperature, the varying ratio of temperature (°C.) is used. If the absolute moisture (gm/cm$^3$), the varying ratio of moisture per unit is used. If the relative moisture (%), the varying ratio of the moisture against room temperature. If the infrared ray (cm), the varying ratio of infrared ray wave in accordance with the temperature variation is used. Any one of these can be used to compute the heating time of food as having a similar characteristic as shown in FIG. 5 with one another.

Figure 6:
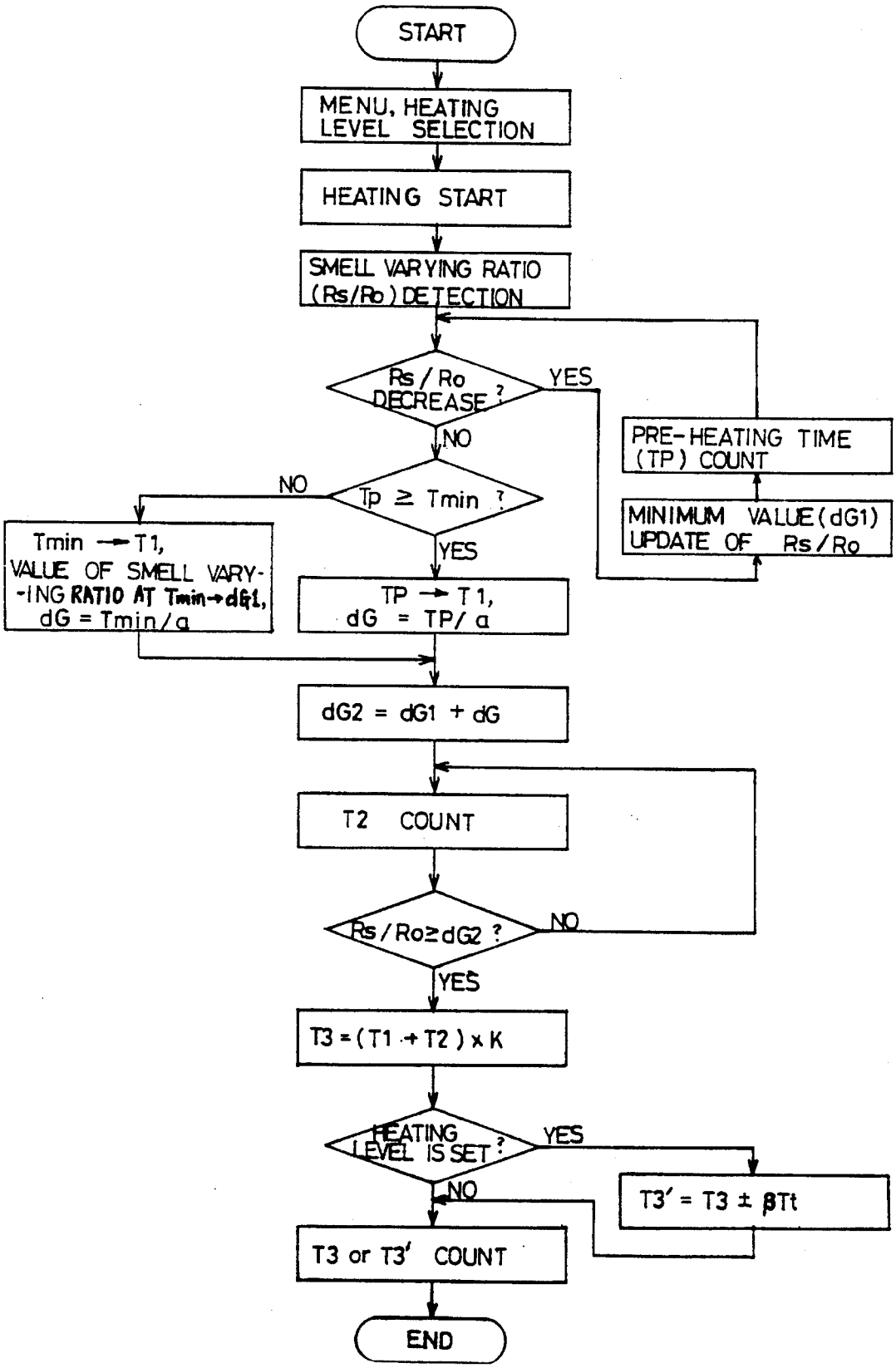
FIG. 6 is a flow chart showing a heating time control method of a microwave oven according to the present invention.

Referring to FIG. 6, the procedure of setting the heating time of food will now be explained below.

After placing a food in the heating compartment 2, a user selects a heating level in accordance with the kind of food to be cooked. Thereafter, the counter 11 counts time in accordance with a mode selected by the user and outputs the counted time to the output drive circuit 12. The output drive circuit 12 controls the oscillation of the magnetron 13 in accordance with a predetermined signal of the counter 11.

Thereafter, the magnetron 13 supplies the heating compartment 2 with microwaves, whereby the food in the heating compartment 2 is cooked.

When the food is cooked, smell and gas occur and are exhausted to the outside through the air exhausting opening 4. At this time, the sensor 5 close to the air exhausting opening 4 detects the smell being exhausted and converts the detected state into a predetermined electric signal and outputs the signal to the converter 6. The converter 6 computes the varying ratio Rs/Ro of smell using the initial value Ro outputted from the sensor 5 and the varying value Rs obtained as time passes and outputs the computed results to the detector 7.

The heating time detector 7 detects a minimum value dG1 as the varying ratio of smell decreases and then increases and outputs the detected value to the storing circuit 8. In addition, the heating time detector 7 detects the preheating time Tp until the minimum value dG1 is detected and compares the preheating time Tp with the minimum time Tmin set in the minimum time setting circuit 14. As a result of the comparison, if Tp >Tmin, the heating time detector 7 selects the Tp as the first heating time T1 and outputs the selected time to the storing circuit 8 and the counter 11. If Tp≦Tmin, the heating time detector 7 selects the Trim as the first heating time T1 and outputs the selected time to the storing circuit 8 and the counter 11.

Thereafter, the storing circuit 8 outputs the minimum value dG1 and the first heating time T1 to the operator 10, and the coefficient storing circuit 9 outputs the coefficient e in accordance with the kind of food to the operator. In addition, the operator 10 operates the variation (dG=T1/a) of the varying ratio of smell so as to determine the second heating time T2 and adds the minimum value dG1 of the varying ratio of smell to the operated value dG and outputs the added value (dG2=dG1+dG) to the detector 7.

The heating time detector 7 detects the time T2 that the varying ratio of smell reaches from the dG1 to the value dG2 outputted from the operator and outputs the detected time T2 to the storing circuit 8 and the counter 11. The operator 10 computes the third heating time T3 for the second heating time T2 using the first and second heating times T1 and T2 and the coefficient K stored in the coefficient storing circuit 9. Here, the third heating time T3 is computed as a T3=K(T1+T2) outputted to the counter 11.

The operator 10 judges whether or not a control of the heating level is inputted by checking the heating time control circuit 15 before outputting the third heating time T3. If there is no inputted heating level control, the operator 10 outputs the operated third heating time T3 to the counter 11. However, if there is a predetermined inputted heating level control, the operator 10 operates the heating time controlled by the user and outputs the result to the counter 11. Therefore, the counter 13 counts the third heating time T3' controlled by the controlled total heating time Tt' and outputs the counted result to the output drive circuit 12. Thereafter, the output drive circuit 12 drives the magnetron 13 for as much as the time t3' and then the cooking operation is terminated.

As described above, the heating time control apparatus and the method thereof according to the present invention is directed to computing the second and third heating time by computing a varying ratio of smell in the first heating period, whereby a wide range of foods can be cooked under optimum conditions without controlling the amount of food and without regard to the initial temperature conditions such as the frozen state, refrigeration state, and room temperature state of food. In addition, the present invention is intended to prevent the food from being overheated when warming or reheating the food by using the first heating time when there is no minimum point in the curve indicating the varying ratio of smell or there is no minimum value, so that the optimum cooking condition is attained.

What is claimed is:

1. A heating time control apparatus, comprising:

sensor means for repeatedly detecting a predetermined parameter of a food as the food is being heated and for converting variations of the parameter into a predetermined electrical signal;

converting means for comparing the parameter to an initial value thereof and for converting the parameter into a varying ratio based on the initial value;

heating time detecting means for setting a first heating time based on the varying ratio reaching a minimum value and for setting a second heating time based on the varying ratio varying from the minimum value to a predetermined value;

storing means for storing a minimum value outputted from said heating time detecting means, said first heating time, and said second heating time;

coefficient storing means for storing a predetermined coefficient in accordance with kinds of food to be cooked;

operating means for outputting a quotient obtained by dividing the first heating time by a first coefficient from said coefficient storing means in order for the second heating time to be determined in said heating time detection means, and for calculating a third heating time by multiplying a sum of the first and the second heating times by a second coefficient from said coefficient storing means;

a counter for producing microwave drive signals based on the first and second heating times outputted from the heating time detecting means and the third heating time outputted from said operating means; and output drive means for controlling a supply of a microwave energy to the food in accordance with the drive signals of said counter.

2. The apparatus of claim 1, wherein said sensor means is effective for measuring a predetermined parameter variation selected from the parameter group of gas, smell, temperature, absolute moisture, relative moisture, infrared rays and combinations thereof.

3. The apparatus of claim 1, wherein said heating time detecting means selects a predetermined set time as a first heating time in the event when a minimum value of the varying ratio is not reached and outputs a value of the varying ratio at the selected time as a minimum value first heating time.

4. The apparatus of claim 1, wherein said second heating time represents time during which the varying ratio varies by a predetermined value from the completion of the first heating time.

5. The apparatus of claim 1, wherein said operating means includes a heating level selected by a user and said operating means produces said third heating time controlled in accordance with the heating level, by multiplying a total heating time by a predetermined coefficient determined by the heating level and by adding or subtracting the multiplied value to or from the third heating time.

6. The apparatus of claim 1, wherein said predetermined value is obtained by dividing said first heating time by a first coefficient.

7. A heating time control method, comprising the steps of:

converting a physical parameter of a food while the food is being heated into a varying ratio based on an initial value of said parameter and setting a first heating time while the converted varying ratio becomes a minimum value;

computing a predetermined divided value by dividing the first heating time by a first coefficient in accordance with the kind of food being cooked and setting a second heating time while said varying ratio converts as much as said divided value from the minimum value;

calculating a third heating time by multiplying a second food kind coefficient by the sum of said first heating time and said second heating time; and ending the entire heating process when said calculated third heating time has elapsed.

8. The method of claim 7, wherein said step of setting said first heating time includes selecting a predetermined set time as said first heating time when said varying ratio increases and outputs a value of the varying ratio in the selected time as a minimum value.

9. The method of claim 7, including obtaining said third heating time in accordance with a predetermined heating level by adding or subtracting a value obtained by multiplying a computed total heating time by a predetermined coefficient to and from the third heating time just after the third heating time is operated in case that a user controls a heating level.

* * * * *